US006877721B2

(12) United States Patent
Calverley

(10) Patent No.: US 6,877,721 B2
(45) Date of Patent: Apr. 12, 2005

(54) FENCE PANEL DEVICE AND MODULAR FENCE SYSTEM

(76) Inventor: Anthony R. Calverley, 601 Whitney Ave. Suite 4, Lantana, FL (US) 33462

( * ) Notice: Subject to any disclaimer, the term of this patent is extended or adjusted under 35 U.S.C. 154(b) by 0 days.

(21) Appl. No.: 10/372,891

(22) Filed: Feb. 24, 2003

(65) Prior Publication Data

US 2003/0122116 A1 Jul. 3, 2003

Related U.S. Application Data

(63) Continuation-in-part of application No. 09/822,047, filed on Mar. 30, 2001, now Pat. No. 6,523,807.

(51) Int. Cl.[7] ..... E04H 17/16
(52) U.S. Cl. ..... 256/24; 256/25
(58) Field of Search ..... 256/24, 25, 59, 256/19, 65.01, 65.02

(56) References Cited

U.S. PATENT DOCUMENTS 3,212,754 A 10/1965 Revell
3,963,219 A 6/1976 D'Amico
4,306,631 A 12/1981 Reusser
4,312,166 A 1/1982 Mock
4,369,953 A 1/1983 Greiner
4,461,461 A 7/1984 Caron
4,498,660 A 2/1985 Brema et al.
4,838,524 A 6/1989 McKeown et al.
4,881,355 A 11/1989 Bosl
4,964,618 A 10/1990 Kennedy
5,149,061 A 9/1992 Borgnini
5,301,926 A 4/1994 Sharp
5,345,716 A * 9/1994 Caplan ..... 49/61
5,628,495 A 5/1997 Gandara
5,938,184 A 8/1999 DeSouza
6,152,428 A * 11/2000 Simioni ..... 256/24
6,398,193 B1 * 6/2002 DeSouza ..... 256/19

* cited by examiner

*Primary Examiner*—John R. Cottingham
(74) *Attorney, Agent, or Firm*—David P. Lhota, Esq.; Stearns Weaver Miller Weissler Alhadeff & Sitterson, P.A.

(57) ABSTRACT

A fencing system and method of manufacturing and installing a fencing system specifically designed to give the appearance of a traditional shadow box or privacy fence, wherein the system uses preformed non-corrosive, structurally sound corrugated panels, posts, posts mounts, channel mounts, and clips that mate and are securable using conventional fasteners.

17 Claims, 17 Drawing Sheets

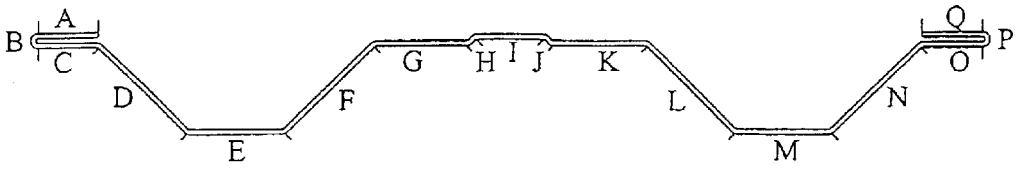

| | | | | | | |
|---|---|---|---|---|---|---|
| A | X Start | 0.75 | X End | 0.3725 | Angle | 180 |
| | Y Start | 2.2025 | Y End | 2.2025 | Length | 0.3775 |
| B | X Center | 0.3725 | Radius | 0.06 | Start Angle | 90 |
| | Y Center | 2.1425 | | | End Angle | 270 |
| C | X Start | 0.875 | X End | 0.3725 | Angle | 180 |
| | Y Start | 2.0825 | Y End | 2.0825 | Length | 0.5025 |
| D | X Start | 0.875 | X End | 1.312 | Angle | 127.87498 |
| | Y Start | 2.0825 | Y End | 1.52 | Length | 0.71261 |
| E | X Start | 1.1312 | X End | 2.1875 | Angle | 0.0 |
| | Y Start | 1.52 | Y End | 1.52 | Length | 0.875 |
| F | X Start | 2.1875 | X End | 2.625 | Angle | 52.12502 |
| | Y Start | 1.52 | Y End | 2.0825 | Length | 0.71261 |
| G | X Start | 2.625 | X End | 3.0625 | Angle | 0.0 |
| | Y Start | 2.0825 | Y End | 2.0825 | Length | 0.4375 |
| H | X Start | 3.0625 | X End | 3.125 | Angle | 45 |
| | Y Start | 2.0825 | Y End | 2.145 | Length | 0.08839 |
| I | X Start | 3.125 | X End | 3.875 | Angle | 0.0 |
| | Y Start | 2.145 | Y End | 2.145 | Length | 0.75 |
| J | X Start | 3.875 | X End | 3.9375 | Angle | 135 |
| | Y Start | 2.145 | Y End | 2.0825 | Length | 0.08839 |
| K | X Start | 3.9375 | X End | 4.375 | Angle | 0.0 |
| | Y Start | 2.0825 | Y End | 2.0825 | Length | 0.4375 |
| L | X Start | 4.375 | X End | 4.8125 | Angle | 127.87498 |
| | Y Start | 2.0825 | Y End | 1.52 | Length | 0.71261 |
| M | X Start | 4.8125 | X End | 5.6875 | Angle | 0.0 |
| | Y Start | 1.52 | Y End | 1.52 | Length | 0.875 |
| N | X Start | 6.125 | X End | 5.6875 | Angle | 52.12502 |
| | Y Start | 2.0825 | Y End | 1.52 | Length | 0.71261 |
| O | X Start | 6.125 | X End | 6.6275 | Angle | 0.0 |
| | Y Start | 2.0825 | Y End | 2.0825 | Length | .5025 |
| P | X Center | 6.6275 | Radius | 0.06 | Start Angle | 90 |
| | Y Center | 2.1425 | | | End Angle | 270 |
| Q | X Start | 0.75 | X End | 0.3725 | Angle | 180 |
| | Y Start | 2.2025 | Y End | 2.2025 | Length | 0.3775 |

FIG. 18

FENCE PANEL DEVICE AND MODULAR FENCE SYSTEM

CROSS REFERENCE TO RELATED APPLICATIONS

This application is a continuation-in-part of Ser. No. 09/822,047 filed Mar. 30, 2001 now U.S. Pat. No. 6,523,807.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

The present invention relates generally to a fence panel and a fence assembly system, and more particularly, to a contoured rust-proof fence panel of symmetrical proportions, fence assembly system having mechanically cooperating parts that incorporate the panels, facilitate convenient fence installation and include linear and curvature designs, and method for making fence panels.

2. Description of the Background Art

Wood fences and shadow box designs for wood fences are known in the art. However, weather conditions affect the appearance and structural integrity of wood fences over time. Fences constructed from alternative materials, such as aluminum and plastic based material, are resistant to inclement weather, last longer and easily maintained, but are not available in shadow box or other panel-like designs and can not be easily customized. Rather, the typical aluminum fence comprises a prefabricated railing apparatus having a top and bottom rail and a plurality of posts bridging the top and bottom rails. Other metal fences known include horizontal panels that fit into post slots and various structure for joining vertical panels between two rails. The metal fences known can be difficult to construct, offer little options in design, such as shadow box, privacy designs and curved designs, and are relatively expensive. In addition, they fail to adequately address security issues, such as theft of fence components or sections. If a metal fence device and system could address these gaps in the prior art, such a fence design would be easier and quicker to construct than conventional wood fence designs and would be well received.

Various fence designs are known in the art, but none of these addresses or solves the above-noted problems associated with metal fence designs and construction. For instance, U.S. Pat. No. 3,963,219 discloses an aluminum fence having a plurality of horizontally disposed panels and a plurality of support posts having slots for receiving the ends of the panels. U.S. Pat. No. 4,306,631 discloses a noise barrier wall and mounting assembly comprising posts, top and bottom girts and a plurality of vertically disposed panels that fit between and within the girts. U.S. Pat. No. 4,312,166 discloses a wall assembly comprising walls having connecting elements that interlock to join adjacent wall panels. U.S. Pat. No. 4,461,461 discloses a non-corrosive security railing comprising a lower railing and upper railing have holes for receiving vertical railing elements, posts formed by laminating a first pipe and second pipe and conventional connectors. U.S. Pat. No. 4,498,660 discloses a modular fence structure comprising modular panels having a rail portion and connector at each end for concentrically mounting over posts. U.S. Pat. No. 4,838,524 discloses a noise barrier system comprising a front corrugated panel, a rear corrugated panel, a central corrugated panel and noise absorbing material separating the panels. U.S. Pat. No. 5,149,061 discloses a panel for road construction comprising a plurality of interlocking panels and a base that mounts to a central road barrier. U.S. Pat. No. 5,301,926 comprises a prefabricated simulated wrought iron fencing system comprising iron fence rails, floor-anchored posts and T-connectors. U.S. Pat. No. 5,628,495 discloses a metal fence structure comprising corrugated panels, lateral stiffeners, posts and fasteners for securing the panel assemblies. U.S. Pat. No. 5,938,184 discloses a plastic fence construction comprising top, bottom and middle rails, channels defined by the rails for receiving panels, posts, and connectors for securing the rails to the posts. The patents found failed to disclose or suggest all the elements of the instant invention, such as C-channels, post mounts, panels and security devices as contemplated by the instant invention.

As the above noted art fails to provide a fencing system that can be easily installed, is made of a non-corrosive material, provides for a shadow box or privacy fence appearance, has security devices and is structurally durable, there exists a need for such a fencing system. The instant invention addresses this need in the prior art. In addition, the method for making the fence panels and components may be used to prefabricate the fence panels remotely from the job site so panels may be delivered to the job site ready for convenient installation. The instant invention address the foregoing by providing a fencing system as described herein.

BRIEF SUMMARY OF THE INVENTION

Based on the foregoing, it is a primary object of the instant invention to provide a fence system that is constructed for easy installation and method of manufacturing the same.

It is an object of the instant invention to provide a fence system that is adaptable to multiple linear designs as well as curved designs.

It is also an object of the present invention to provide a cost effective means for providing and erecting a fencing system.

It is another object of the present invention to provide a fence system that may be customized for shadow box, curved or privacy designs.

It is a further object of the present invention to provide a fencing system that can be installed by a person without experience in fence installation.

It is an additional object of the instant to provide a unique panel design for use in shadow box or privacy fence construction.

It is yet another object of the instant invention to provide panels that may be interlocked.

Another object of the invention is to provide a flexible and cost-effective method for manufacturing corrugated fence panels.

A further object of the instant invention is to provide a method for installing a shadow box or privacy fence using the fence system of the instant invention.

An additional object of the instant invention is to provide a fence system having security devices for preventing the theft of fence sections or components.

In light of these and other objects, the fence system of the instant invention preferably comprises a plurality of posts, corrugated panels, post mounts and lateral channel mounts. The posts are secured in the ground at a distance and in a manner that can securely support the weight of the post mounts, channels and panels, as well as external forces. Two post mounts have at least one ledge for attaching the lateral channel mounts and are preferably slid over and secured to the posts proximal the top and bottom of the posts, respectively, using conventional hardware. The lateral channel mounts are secured to corresponding post mounts in a manner that bridges the two posts for receiving the panels. The channel mounts may be straight, curved at a plurality of different radii, or substantially S-shaped to provide a plurality of fence design options. The panels comprise a corrugated construction and substantially symmetrical design and are secured vertically to the channel mounts at predetermined distances using conventional hardware. The panels are preferably constructed from a sheet-like aluminum, with specific bends to create a corrugated look and to allow the installation of a shadow box or privacy fence that is strong, uniform and aesthetically pleasing. The panels can comprise various lengths and widths, heights and looks. The edges of the panels may include a bend or hem across the length of the panel for directly or indirectly interlocking adjacent panels, providing a smooth reinforced edge and facilitating proper panel spacing. Thus, the invention may further include clips for interlocking adjacent panels. The clips may be relatively short or long and wide or narrow to achieve a shadow box or privacy design. The components of the fence panel system are preferably made from a non-corrosive, malleable material such as aluminum, stainless steel, plastic based materials, fiberglass material or alternative materials exhibiting non-corrosive, water resistant and durable characteristics.

The system and method of the invention provides the installer with an easy to install fencing system designed to meet standard installation requirements. Moreover, the use of the fencing system will save time and money during the installation process. This is an import object of the present invention.

The instant invention further comprises methods for making the fence panels and installing the fence of the instant invention. The method for making fence panels includes taking a malleable sheet-like material, as described herein, feeding it through a slicer for making multiple panels at once and a series of rollers that create symmetrical corrugated panels with at least two crests.

The instant invention facilitates the prefabrication of fence panel sections comprising the panels attached to the channel mounts. The preferred method of installation comprises setting the posts in the ground or other surface, mounting the post mounts to the posts and, or attaching a channel mounting clip to a wall surface if starting a section from a wall-like surface. Another method of installation comprises obtaining the posts, post mounts, channels and panels that comprise the system of the invention, securing the post in a ground or floor like surface, securing two post mounts to each post, bridging the distance between the posts with lateral channel mounts secured to the post mounts near each end, resulting in the fence system frame, and securing the panels to the frame with our without a gap there between. The method of installation may further comprise the use of clips for uniformly controlling the distance or lack thereof between the panels and/or to facilitate a shadow box or privacy fence design.

In accordance with these and other objects, which will become apparent hereinafter, the instant invention will now be described with particular reference to the accompanying drawings.

BRIEF DESCRIPTION OF THE SEVERAL VIEWS OF THE DRAWINGS

FIG. 18 is an end view and tabular depiction of the relative section sizes and angles of the preferred panel of the instant invention.

DETAILED DESCRIPTION OF THE INVENTION

Figure 1:
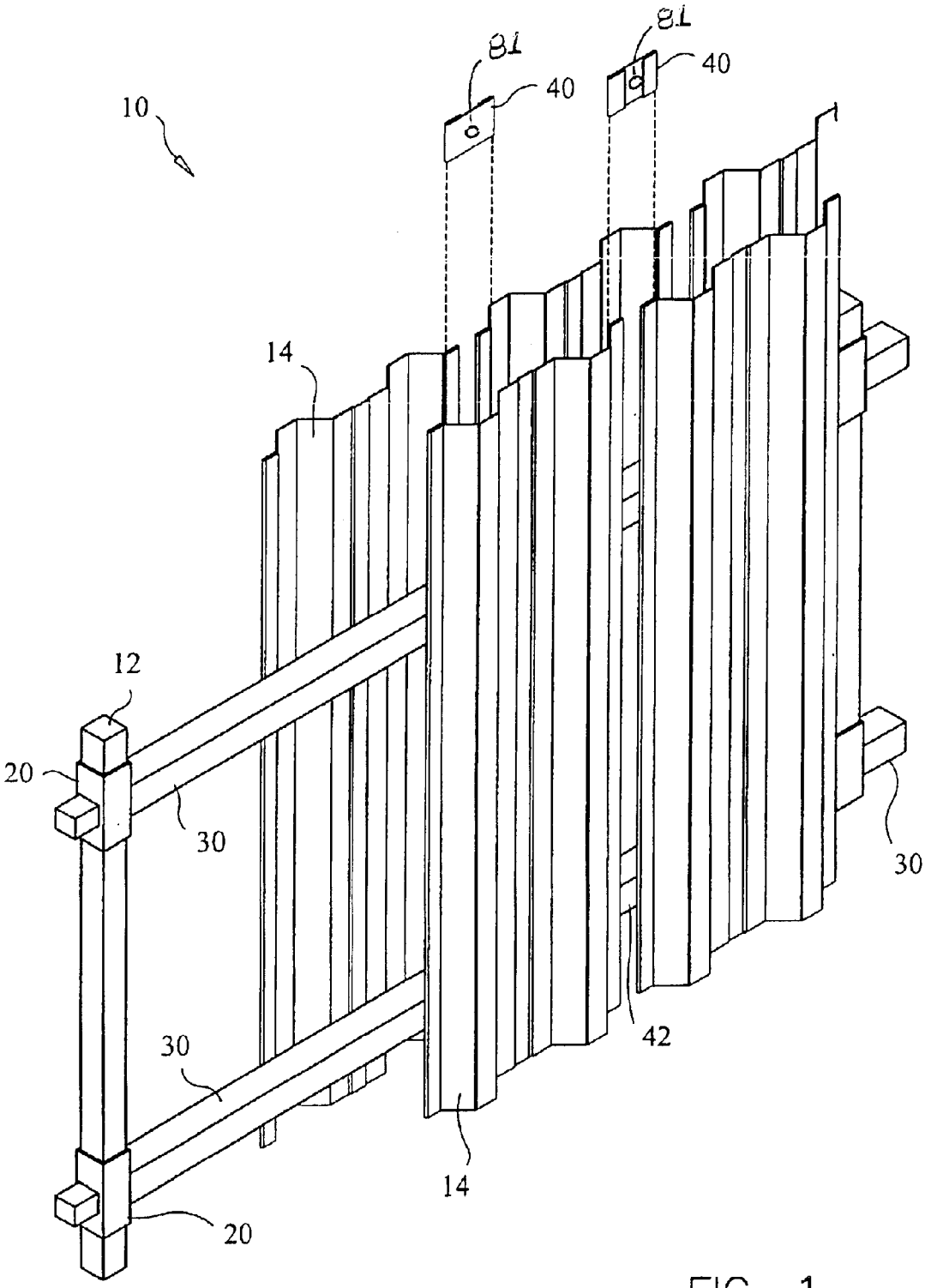
FIG. 1 is a front perspective view of the preferred embodiment of the fence panel system of the instant invention arranged in a shadow box design.

With reference to the drawings, FIGS. 1–22 depict the preferred and alternative embodiments of the instant invention, which is generally characterized by numeric character 10 and/or as a fence or fence system. Referring to FIG. 1, the Fence System 10 preferably comprises a plurality of Posts 12, Panels 14, Post Mounts 20 and Channel Mounts 30. The Fence System 10 is designed to provide an economical, functional, easy to install and customizable fence, such as shadow box, curved or privacy designs. The Posts 12 are preferably rigid and square or rectangular in cross section to provide a flat outside securing surface for structural integrity and can comprise lengths that confirm with recognized standards in the industry, such as eight feet, or lengths that comport with local building codes. The Posts 12 are securable in a ground or ground like surface, such as with cement or dirt, and can comprise a substantially non-corrosive, waterproof and durable material. The preferred material for all components comprises aluminum or an aluminum based product, or alternatively may comprise plastic, plastic based or fiberglass type materials.

Figure 8:
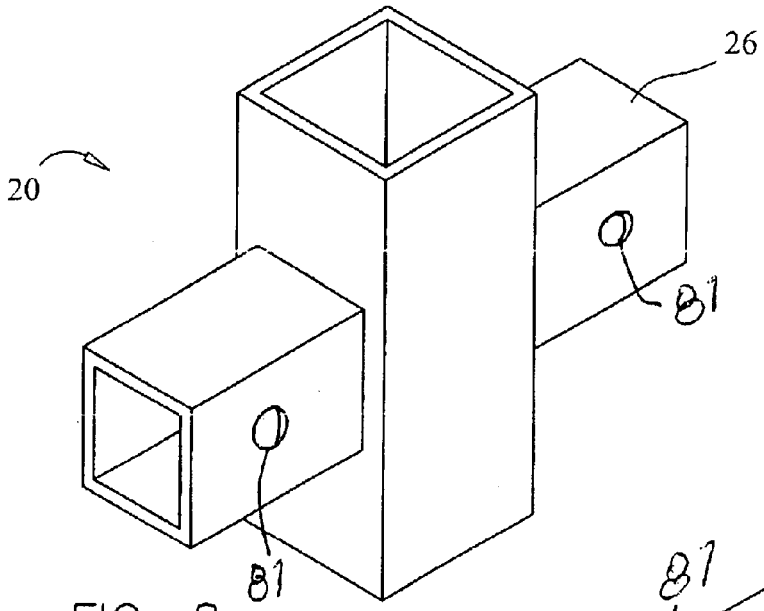
FIG. 8 is a perspective view of a first embodiment of the post-mount of the instant invention illustrating a ledge projecting from opposite surfaces.
Figure 8A:
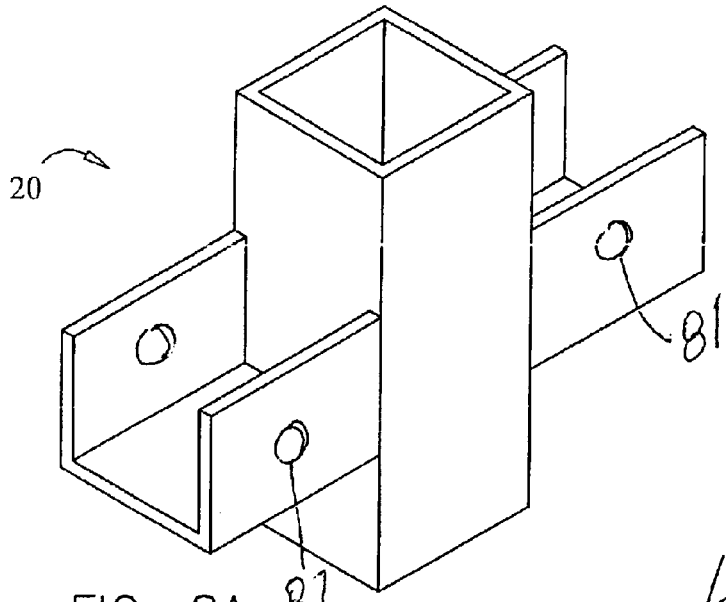
FIG. 8A is a perspective view of a first embodiment of the post-mount of the instant invention illustrating a U-Shaped ledge projecting from opposite surfaces.
Figure 8B:
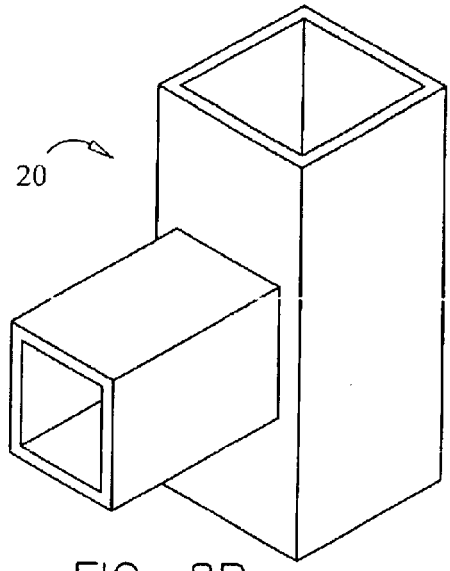
FIG. 8B is a perspective view of a second embodiment of the post-mount of the instant invention illustrating one ledge projecting from a surface.
Figure 8C:
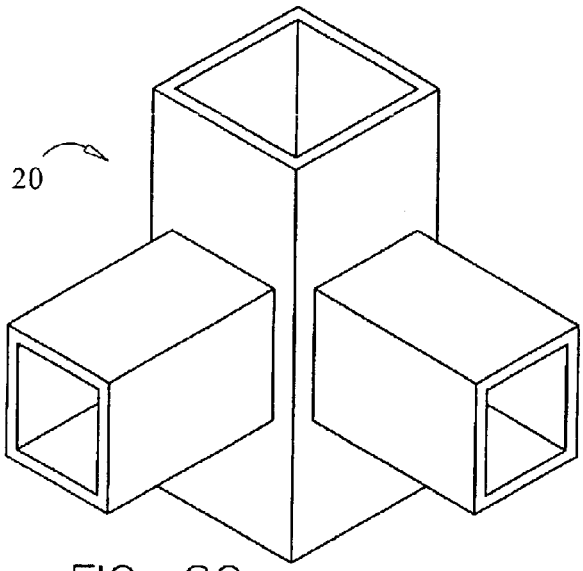
FIG. 8C is a perspective view of a third embodiment of the post-mount of the instant invention illustrating a ledge projecting from adjacent surfaces.
Figure 8D:
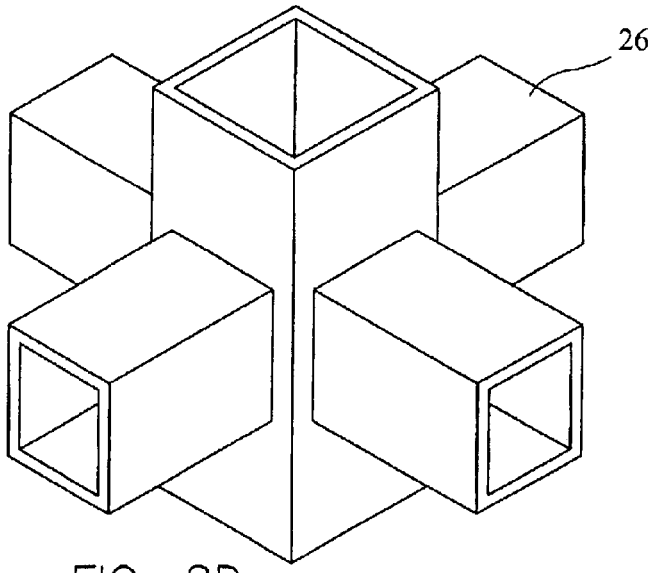
FIG. 8D is a perspective view of a fourth embodiment of the post-mount of the instant invention illustrating a ledge projecting from all surfaces.

The Post Mounts 20, shown in detail in FIGS. 8–8D, slide over the Post 12 and are securable thereto using conventional fasteners, such as screws, nuts and bolts and the like. The Post Mounts 20 preferably fit snuggly over the Post 12 to prevent chattering while providing stability in the fence structure. Each Post Mount 20 comprises at least one ledge 26. The ledges 26 may comprise a tube, as shown in FIG. 8, or a U-shaped channel ledge, as shown in FIG. 8A. With reference to FIG. 8, a tube shaped ledge 26 preferably has the same width as the supporting vertical column for flush mounting of the Panels 14. With reference to FIG. 8A, the U-shaped ledge 26 preferably has a smaller width than the supporting vertical column so that the Channel Mount 30 lies flush with the center support column when installed. With reference to FIGS. 8, 8A, 8B, 8C and 8D, the ledges 26, whether constructed as a tube or U-shaped channel, may project from two opposite surfaces (8 and 8A), one surface (8B), two adjacent surfaces (8C) or every surface (8D), respectively. The Ledges 26 preferably have dimensions that firmly support the Channel Mount 30 in a manner that prevents or limits potential vibration and chatter.

Figure 4A:
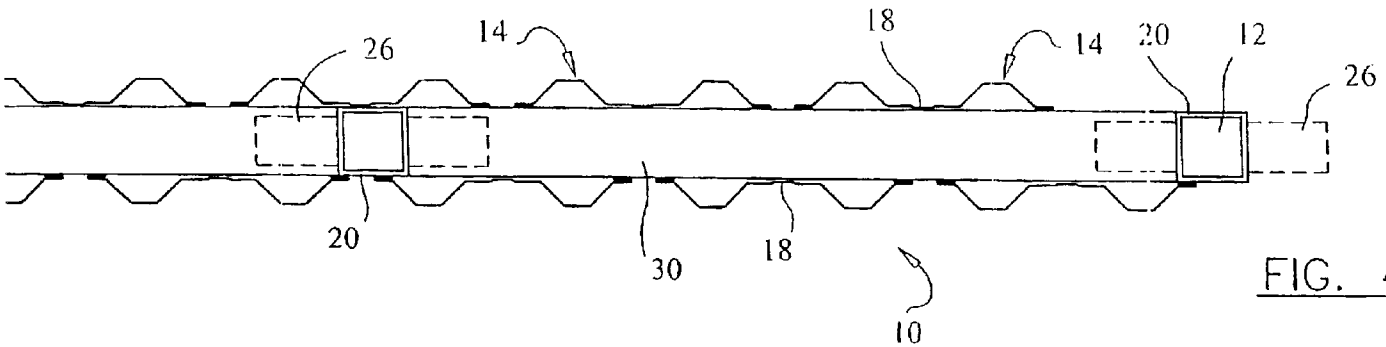
FIG. 4A is a plan view of a fence panel system of the instant invention.
Figure 5:
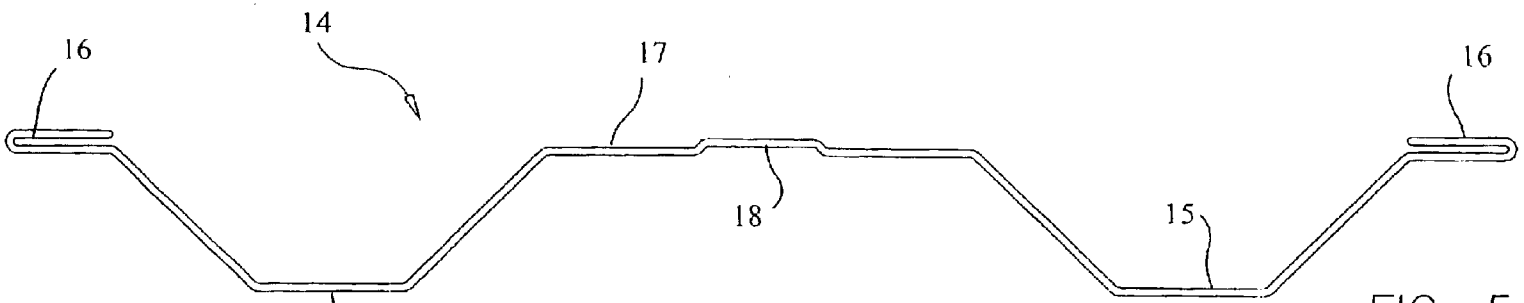
FIG. 5 is an end view of the preferred fence panel of the instant invention.
Figure 4B:
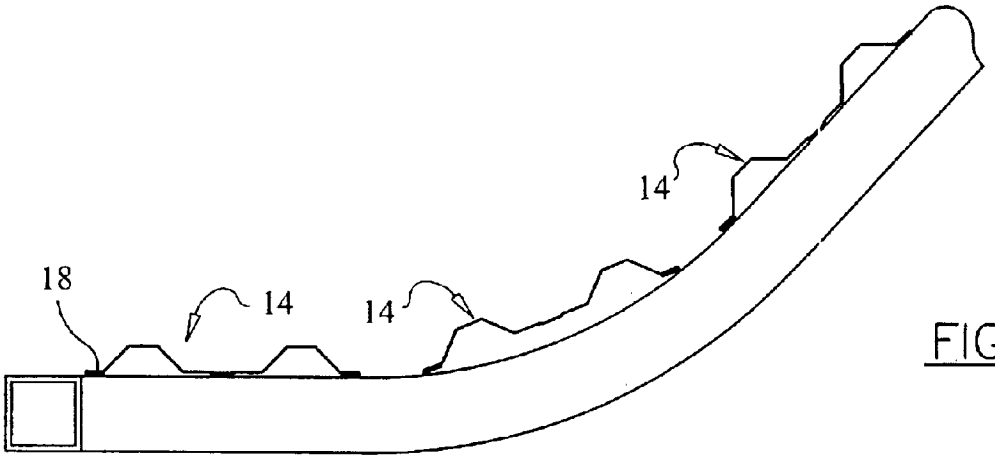
FIG. 4B is a plan view of another embodiment of the fence panel system of the instant invention illustrating an arcuate fence system.
Figure 4C:
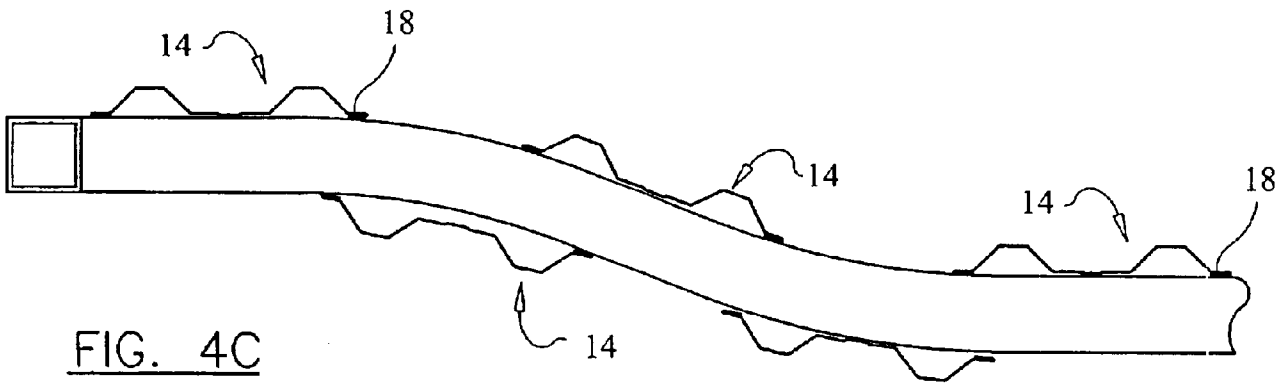
FIG. 4C is a plan view of another embodiment of the fence panel system of the instant invention illustrating an "S-like" structure.
Figure 9:
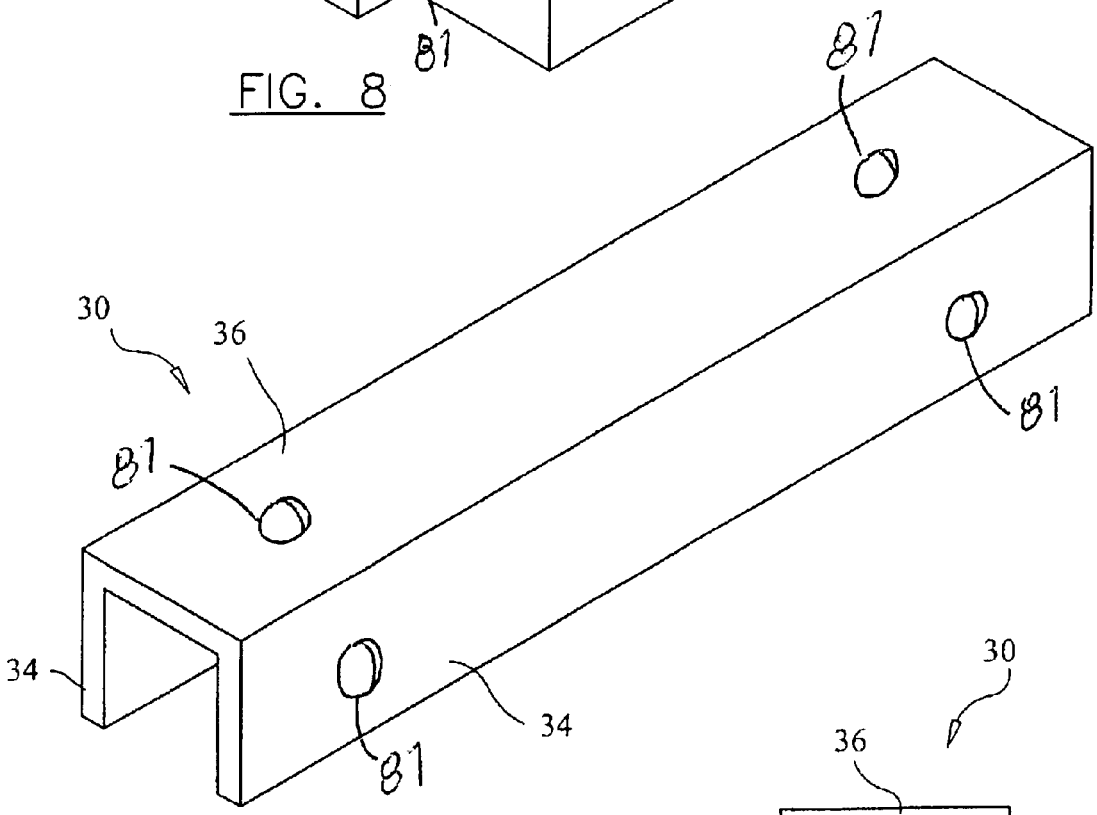
FIG. 9 is a perspective view of the preferred embodiment of the channel mount of the instant invention used with the first embodiment of the post mount.
Figure 10:
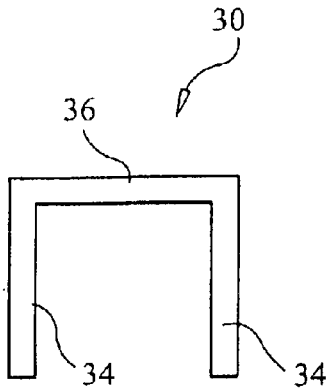
FIG. 10 is an end view of the preferred embodiment of the channel mount of the instant invention used with the first embodiment of the post mount.
Figure 9A:
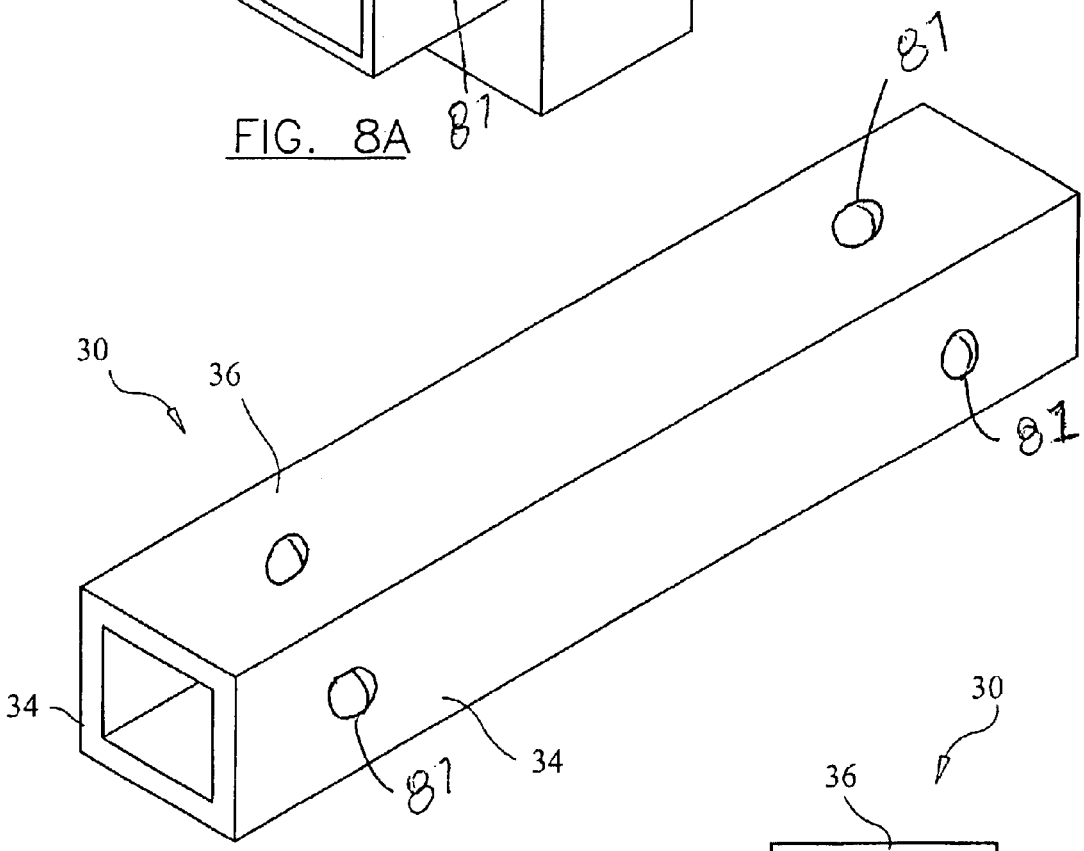
FIG. 9A is a perspective view of the preferred embodiment of the channel mount of the instant invention used with the second embodiment of the post mount.
Figure 10A:
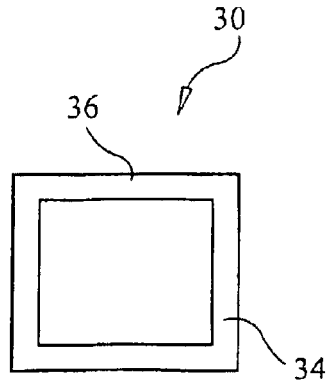
FIG. 10A is an end view of the preferred embodiment of the channel mount of the instant invention used with the second embodiment of the post mount.

With reference to FIGS. 4A–4C, 9, 9A and 10A, the Channel Mounts 30 comprise crossing support members that span between Posts 12 and attach to the Post Mount Ledges 26. With reference to FIGS. 9 and 10, the Channel Mount 30 may be U-shaped in cross-section for snugly mounting over the tube-shaped Ledge 26, preferably with the open side down. With reference to FIGS. 9A and 10A, the Channel Mount 30 may be tube-shaped in cross-section for snugly mounting inside the U-shaped Ledge 26. The Channel Mounts 30 preferably conceal the hardware. With reference to FIGS. 4A–4C, the Channel Mounts 30 may be straight, curved or S-shaped to accommodate different geometric layouts. As shown in FIGS. 1, 2 and 4A–4C, a Channel Mount 30 is secured to the Post Mount 20 to provide a lateral support surface for affixing the Panels 14. The Channel Mounts 30 extend between two posts per section of fence to provide a lateral support surface for securing the Panels 14. Each fence section preferably employs two (2) Posts 12, two (2) Post Mounts 20 securely affixed to each post, two (2) Channel Mounts 30 laterally extending between the Posts 12 and secured to corresponding Post Mounts 20 and a plurality of Panels 14 vertically secured to the Channel Mounts 30 and/or Post Mounts 20. As shown in FIG. 1, Short Clips 40 may be used to secure and properly space adjacent Panels 14 and to assist in preventing chattering of the Panels 14. The Short Clips 40 are preferably used in a shadow box design in a manner that does not comprise the shadow box look.

Figure 2:
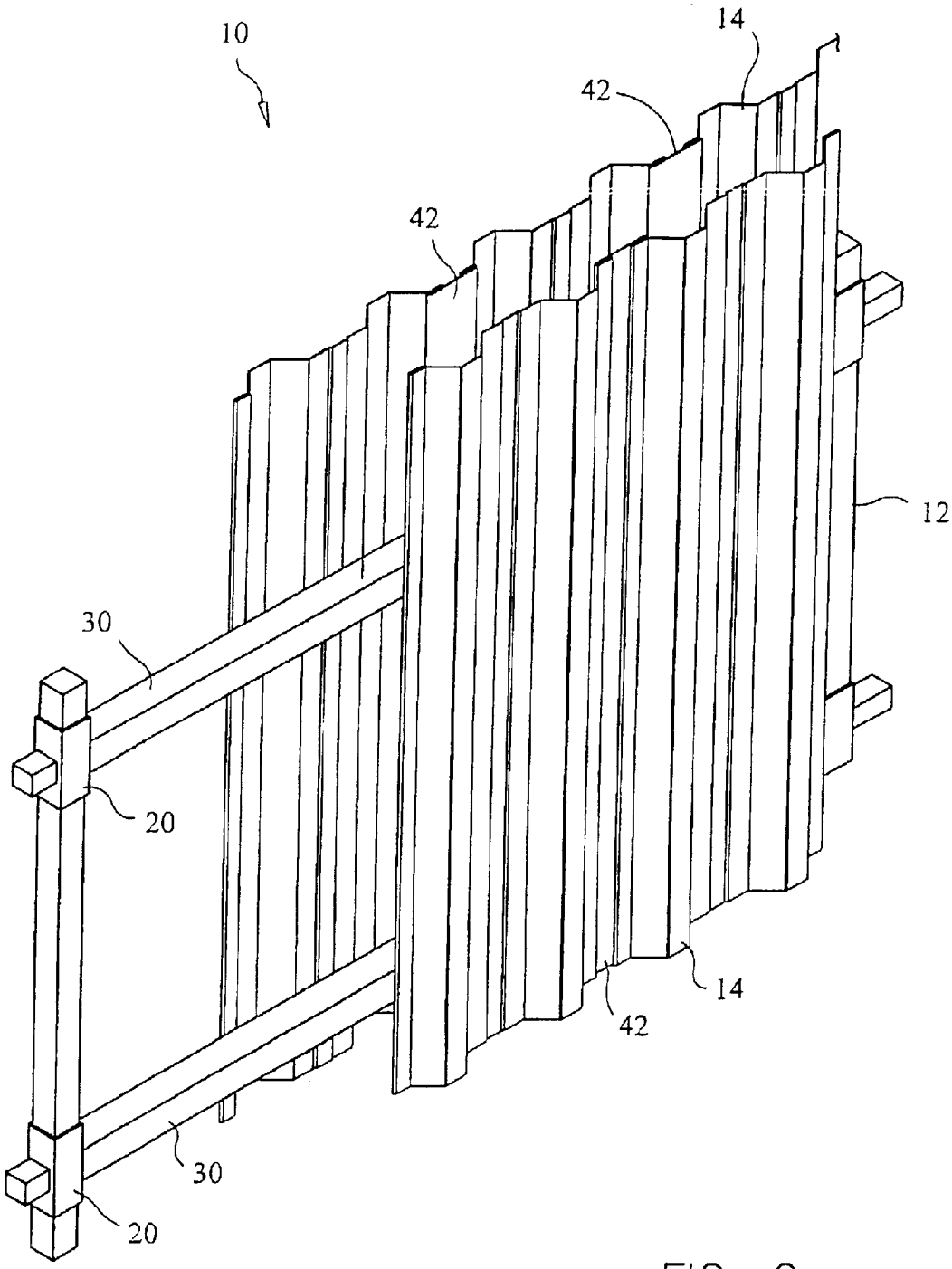
FIG. 2 is a front perspective view of the preferred embodiment of the fence panel system of the instant invention arranged in a privacy design.

With reference to FIG. 2, a fence section of the instant invention 10 is shown in a privacy design. As in the preferred embodiment, each section of fence preferably includes two (2) Posts 12 spaced apart at a predetermined distance, two (2) Post Mounts 20 per post, two (2) Channel Mounts 30 laterally bridging the post and connected to corresponding Post Mounts 20 and a plurality of Fence Panels 14 affixed to the Channel Mounts and/or Post Mounts 20 in a manner that eliminates gaps between the Panels 14. In one embodiment, the Panels 14 in the privacy design may be juxtaposed such that there is no space there between. In this design, additional stability and security may be provided by employing either the Small Clips 40 or Large Clips 42 to keep the panels joined together. In another embodiment, the Large Clips 42 may be used to secure the Panels 14 while filling the space between adjacent Panels 14 so as to eliminate any gaps there between. With reference to FIGS. 4B and 4C, the Fence System 10 may be curved, including S-shaped, by using the corresponding Channel Mounts 30.

Figure 3:
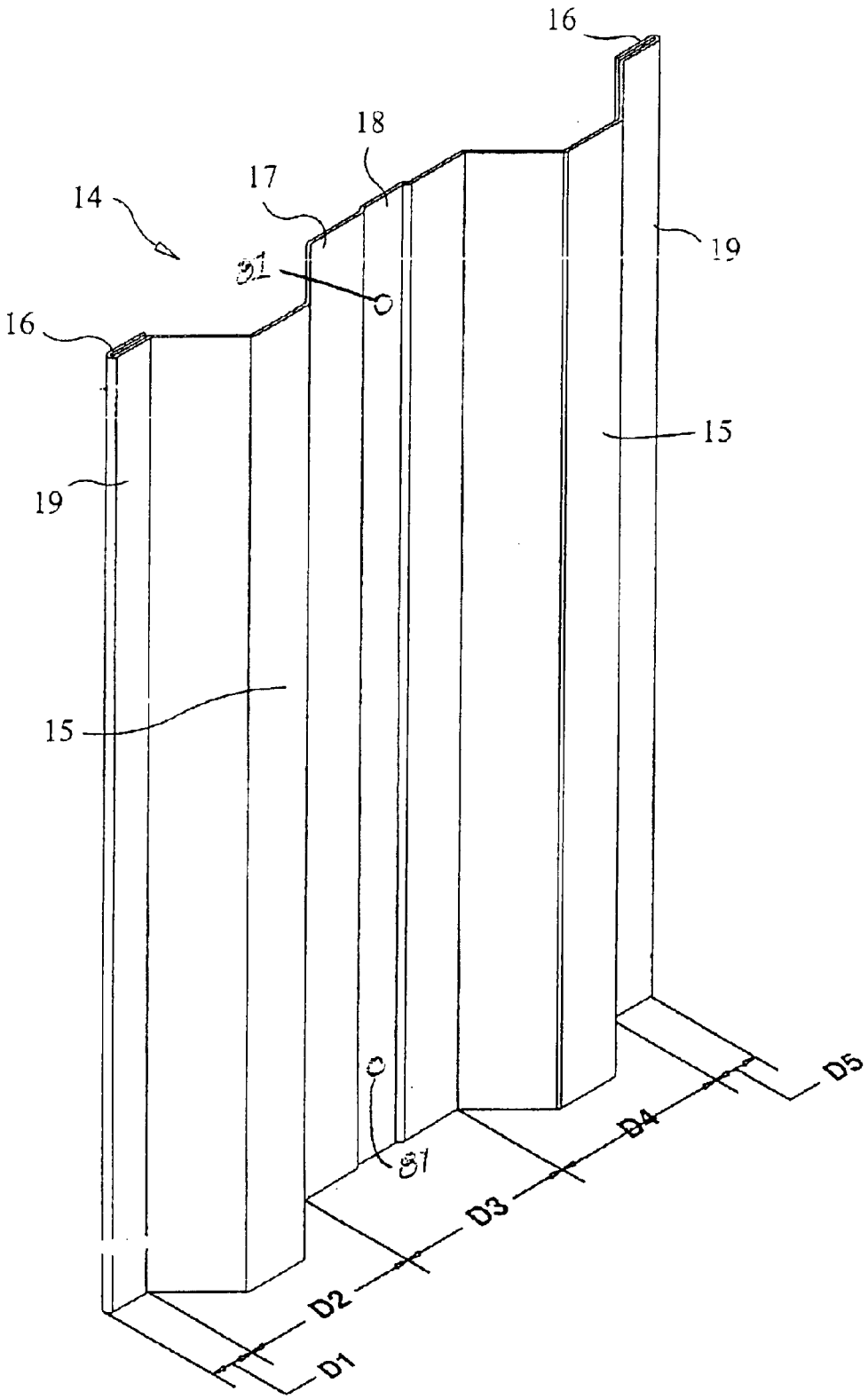
FIG. 3 is a front perspective view of the preferred embodiment of a fence panel in accordance with the instant invention.

With reference to FIG. 3, a typical Fence Panel 14 is shown. Although shown in full size, the Panel 14 may comprise a fraction of the width shown, such as half, for completing smaller sections or starting a section. The Fence Panel 14 comprises at least one and preferably two Crests 15, an intervening Panel Trough 17, a Trough Channel 18 and at Edge Segments 19 which form Flange 16. The Crests 15 preferably rise above opposite edges of the Panel Trough 17 so as to define the Trough Section 17. The Crests 15 are preferably trapezoidal in shape, but may vary. The Panel Trough 17 is preferably defined by the valley formed between opposing Crests 15. The Edge Segments 19 are defined on opposite outside edges of the Crests 15, which define the overall width of a particular Panel 14. Each Edge Segment 19 defines a Flange 16. The Flange 16 is formed by folding a segment of the Edge Segment 19 over itself such that the folded section is substantially in parallel with the remaining Edge Segment 19, as shown in FIG. 3. The Flange 16 enhances the structural integrity of the Panel 14 at the Edge Sections 19, provides a smooth finished edge and creates a dimensional characteristic in the Fence 10 that facilitates proper spacing between the Panels 14 in a shadow box design. The Flanges 16 also provide structure for securely interlocking adjacent Panels 14.

As shown in FIG. 3, the panels 14 are substantially uniform and symmetrical. Segment D1 is equal to segment D5 and segments D2, D3 and D4 are equal. In the preferred embodiment, D1 and D5 are equal to one-fourth (¼) of D2, D3 and D4. The preferred Fence Panel 14 has approximately five (5) well defined segment dimensions that create a uniform and substantially symmetrical panel. The segments designated D1 and D5 are equal and comprise approximately ¼ the dimensions of D2, D3 and D4, respectively. The panel sections designated D2, D3 and D4 are each equal in width and are four times the dimension of D1 and D5. These comparative dimensions may vary without departing from the main teachings of the instant invention. The Panel 14 also includes a Trough Channel 18 extending between the upper and lower ends of the Panel 14 and essentially located within the Trough 17. The Trough Channel 18 is recessed into and below the Trough 17 to achieve uniformity across the fence in comparison to the pre-designed gaps between adjacent Panels 14. The width of the Trough Channel 18 is intended to coincide with the width of the gap left between adjacent Panels 14 secured to the Fence 10.

Figure 14:
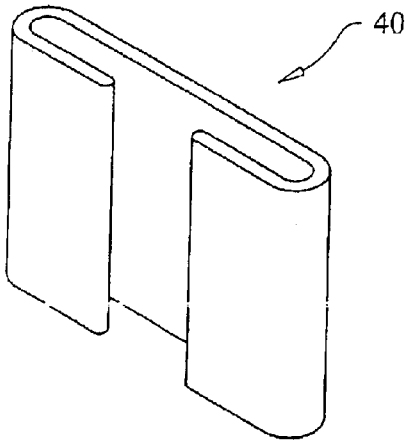
FIG. 14 is a perspective view of the preferred embodiment of the short clip used in the instant invention.

In the preferred embodiment, as shown in FIG. 3, a Small Clip 40 is preferably used to interlock adjacent Panels 14. The Short Clips 40, as shown in FIG. 14, can be used to secure adjacent Panels 14 to prevent or alleviate chatter while providing uniform spacing between Panels 14 throughout the Fence 10. Alternatively, the Clips 40 may be used to securely abut adjacent Panels 14 for a privacy-like design that eliminates all gaps between the panels. A uniform look can be achieved in either a privacy or shadow box fence design depending on the clips employed. For instance, in a shadow box design, the Small Clips 40 would be used so as to maintain the look of a gap between adjacent panels. Conversely, in a privacy fence design, a Large Clip 42 would be used to fill in the gap from the top edge to the bottom edge between adjacent panels so as to securely join two panels at a predetermined distance while filling in the gap there between. Accordingly, the Clips 40 and 42 have a width and dimensions that facilitate uniform and proper spacing between adjacent Panels 14 in a manner that coincides with the width of the Trough Channel 18. Alternatively, the Clips 40, 42 may vary in length and, or width to adjust the size of the gap and, or spacing between the Panels 14 for different design looks.

In an alternative embodiment, the Panels 14, Clips 40, 42, Posts 12, Post Mounts 20 and, or Channel Mounts 30 may be pre-punched or pre-drilled with mounting holes or apertures 81 that allow clearance for fasteners and wires. The Panels 14 would preferably have two mounting holes. The Clip 40, 42 would preferably have one mounting hole.

In an alternative embodiment, the Panel 14 may be perforated with venting holes, such as or similar to holes 81, but in various locations across the Panel to create a single sided or double sided ventilated Fence 10. The Clips 40 and, or 42 may also be perforated with venting holes. By using center perforated Panels 14 with Short Clips 40, a single or double sided ventilated Fence 10 may be constructed. Various unique looks may be achieved by using Panels 14 with one or more rows of perforation holes. A symmetrical look may be obtained by properly positioning the perforations uniformly on the Crests 15 and, or Troughs 17.

With reference to FIG. 4, the preferred Fence System 10 is shown in a plan view. As shown, the Panels 14 are preferably affixed to the Channel Mount 30 and/or Post Mount 20 on both sides using conventional fasteners. As shown, a Gap 11 is left between adjacent panels. The Gap 11 preferably has a width that is substantially equal to the width of the Trough Channel 18 to achieve a uniform look. As shown in FIG. 4, the Channel Mounts 30 are securely mounted to the Post Mounts 20 in a manner that facilitates the secure attachment of Panels 14. The small clips 40 may be used for securing the panels 14 while facilitating a shadow box look. The large clips 42 may be used for facilitating a privacy fence design.

Figure 6:
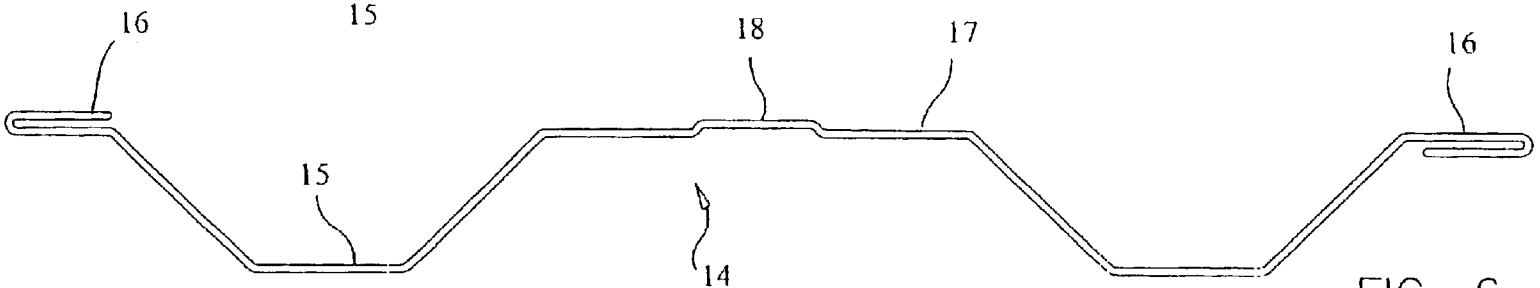
FIG. 6 is an end view of an alternative fence panel of the instant invention.

With reference to FIG. 6, alternative panel designs are shown. Referring to FIG. 6, an end view of the preferred Panel 14 is shown, illustrating flanges, which bend inward behind the Edge Segments 19. With reference to FIG. 6, an alternative Panel 14' is shown. The alternative Panel Design 14 Prime comprises a First Flange 16 which bends behind Edge Segment 19 as previously described and an alternative Flange 16' bends over and in front of the opposite Edge 19. This alternative Panel Design 14' allows adjacent Panels 14 to be directly interlocked to create a privacy fence design. It should also be noted that although Panels 14 are shown as being secured to both sides of a Fence Structure 10, the Panels 14 may be secured to only one side of the Fence 10.

Figure 7:
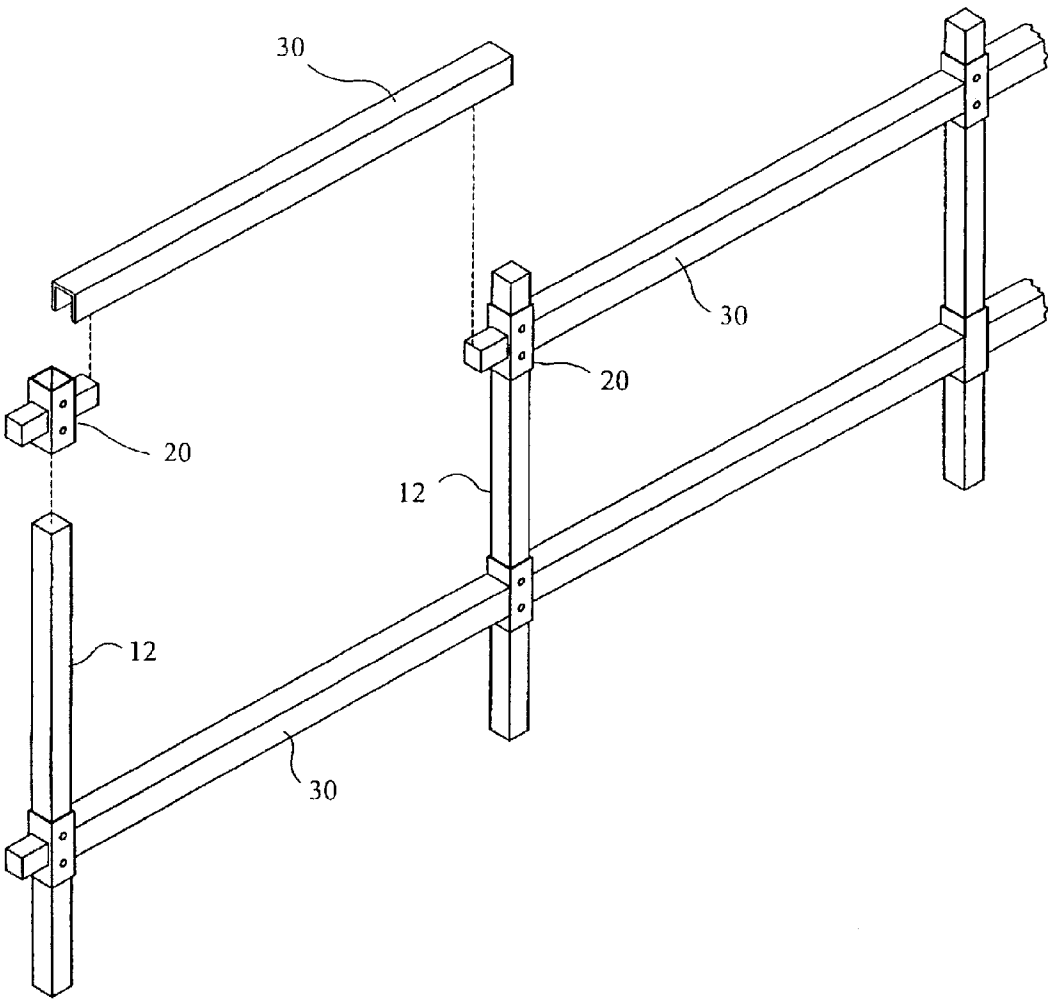
FIG. 7 is a front perspective view of the preferred embodiment of the fence panel assembly of the instant invention with the fence panels removed.

Referring to FIG. 7, a typical fence frame in accordance with the instant invention is shown. The fence frame basically comprises at least one pair of Posts 12, two Post Mounts 20 securely mounted to each Post 12, and a Channel Mount 30 securely mounted and affixed to opposing Post Mounts 20 positioned at corresponding levels on the Posts 12. The Post Mounts 20 and Channel Mounts 30 may be securely fastened using conventional fasteners. The fence frame provides a chassis for securely affixing the Panels 14 thereto.

With reference to FIG. 8, a preferred Post Mount 20 is shown. The preferred Post Mount 20 comprises a Post Sleeve 22 defined by four Sidewalls 23, a Post Barrel 24 defined by the interior surfaces of the Sidewalls 23 and two Channel Ledges 26 projecting outward from opposite Sidewalls 23. The Post Mounts Barrel 24 defines a shape and dimensions that coincide with the Post 12 for facilitating a snug fit therewith to eliminate chattering. The Post Mounts 20 are preferably secured to Posts 12 using conventional hardware, such as screw or bolt fasteners. At least two fasteners per Sidewall 23 are preferred. In an alternative embodiment, the Post Mounts 20 may be secured by cooperating latches, snaps and/or dimples found on or formed in the Posts 12 and Post Mounts 20. The preferred Channel Ledge 26 comprises lateral projections that extend outward from opposite Sidewalls 23 of the Sleeve 22. The Channel Ledge 26 preferably has a square or rectangular cross section that facilitates a mating, and preferably snug, connection with the Channel Mount 30. In an alternative embodiment, the Channel Ledge 26 may comprise an upwardly oriented "U" shaped channel for receiving the Channel Mounts 30. In this embodiment, the Ledger 26 would preferably have drainage ports for draining collected water, such as rain. The alternative design can conceal the hardware used for securing the Channel Ledge 26 and Channel Mount 30 to alleviate the risk of injury.

With reference to FIG. 9, the preferred Channel Mount 30 is shown and comprises two opposing Sidewalls 34 depending from a Top Wall 36. The Sidewalls 34 and Top Wall 36 form a channel adapted for snugly mounting over the Post Mount Ledges 26. Thereafter, the Channel Mounts 30 may be secured with conventional hardware, such as screw or bolt fasteners. Alternatively, the Channel Mounts 30 may be secured to the Ledges 26 by cooperating latches, snaps and/or dimples found on or formed in the mounts 30 and ledges 26. The Channel Mount Ends 32 preferably abuts the Post Mounts 20 to maximize the support of the ledge 26. In an alternative embodiment, the Channel Mounts 30 may comprise a square or rectangular cross section that facilitates mating, and preferably snugly, with the alternative post ledges 26.

With reference to FIG. 10, an end view of the Channel Mount End 32 is shown and comprises a substantially "U" shaped configuration. The Channel Mount 30 defines a channel of a predetermined width between the Sidewalls 32 that corresponds to the width of the Channel Ledge 26. The Channel Mount Sidewalls 34 preferably have a height that corresponds to the height of the Channel Ledge 26 for completely enclosing the Channel Ledge 26 within a corresponding end of a Channel Mount 30. In alternative embodiments, the Channel Ledge 26 and corresponding Channel Mount 30 may comprise cross-sectional dimensions and shapes that are other than rectangular or square. However, a square or rectangular cross-section is desired for enhanced structural integrity. The Channel Mounts 30 may further comprise drainage ports, if necessary, for draining collected water, such as rain.

Figure 16:
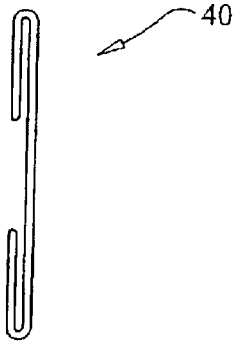
FIG. 16 is an end view of the preferred clip used in the instant invention.
Figure 15:
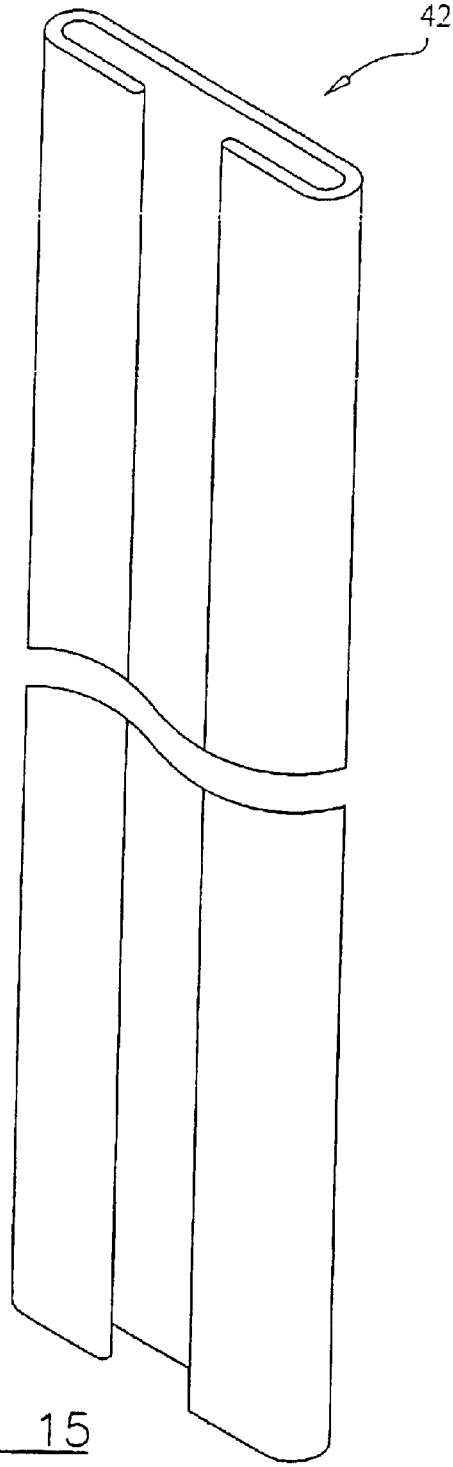
FIG. 15 is a perspective view of the preferred embodiment of the long clip used in the instant invention.

With reference to FIGS. 14–16, the preferred securing Clips 40 and 42 are shown. In one embodiment, the securing clip comprises a Small Clip 40 that is primarily used for shadow box like designs. In a privacy fence design, the Large Clip 42 is preferably used to completely close off any gap between adjacent Panels 14. The Small and Clips 40, 42 both comprise the folded edges or hems that correspond to the Panel Flanges 16 as defined by the Panels 14. Accordingly, the thickness of the flanges defined by the Clips 40, 40 correspond to the gap defined by the Flanges 16 and the Panels 14. The Clips 40 or 42 are installed by aligning a clip end with opposing Flanges 16 of adjacently positioned Panels 14. If the smaller Clip 40 is used, it is preferably slid down over the Flanges 16 into alignment with the Channel Mount 30. The larger Clip 42 has a length that coincides with the length of the Panels 14, such that when the large clip is engaged with adjacent Panels 14 it will substantially fill in the gap between adjacent panels between the top and lower ends. The width and, or length of the clips may vary for different looks.

The Panel Edges 19 and Flanges 16 provide a folded edge or hem edge that increases the rigidity of the panels and aides in reduction of chatter. Moreover, the Edge and Flange Segments 19, 16 provide a smoother edge that is easier to handle during installation. Without a folded hem edge as depicted by the Flange 16 of the Panels 14, wind passing through the fence 10 could cause unwanted vibration and chatter. This is alleviated by the Panel Flanges 16.

The components of the fence panel system 10 are preferably made from a non-corrosive, malleable material such as aluminum, stainless steel, plastic based materials, fiberglass material or alternative materials exhibiting non-corrosive, water resistant and durable characteristics. The Panel Sheet 14 preferably comprises a standard mill coil of the desired material. The Fence System 10 may also include components or be adapted to place adjacent sections at various angles or to traverse curves, such as by using arcuate Channel Mounts 30, Clips 40, 42, and, or Post Mount Ledges 26.

The instant invention further comprises a machine and method for making the Fence Panels 14 of the instant invention and a method for installing the Fence 10 of the instant invention. The process of forming Fence Panels 14 comprises determining the appropriate panel size for field installation given the various design perimeters of the fence to be constructed. However, the present invention may also contemplate manufacturing standard size Panels 14 that could be modified in the field during installation. The method of forming Panels 14 further comprises choosing the appropriate fencing material to be fed into a bending machine, which preferably comprises aluminum, or other suitable non-corrosive, waterproof and durable material, such as plastics or fiberglass. The selected sheet for the Panels 14 are then fed through the bending machine which comprises a series or plurality of uniquely designed and positioned pairs of rollers and, or pairs of cams, as shown in FIGS. 19A–19I, to create the desired bends in the Panel 14, as shown in FIGS. 13A–13J.

Figure 11:
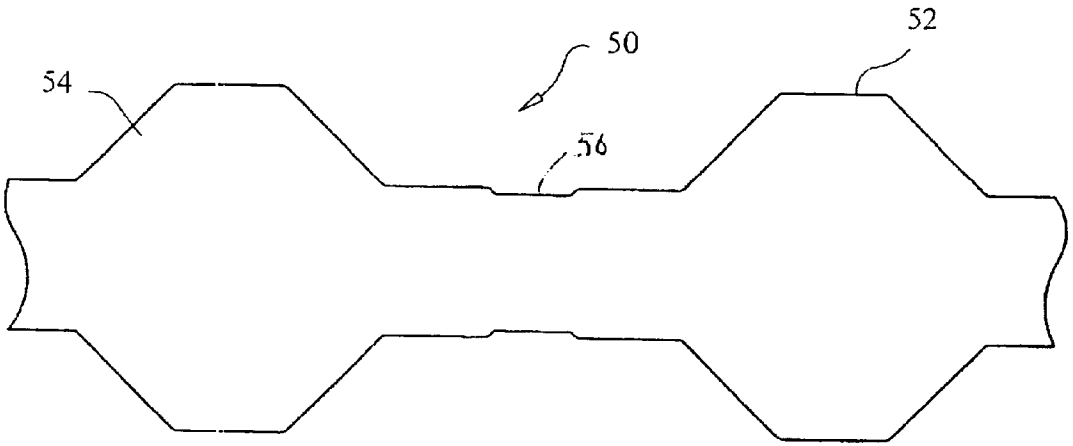
FIG. 11 is an elevational view of the preferred embodiment of the first roller of the machine used in the process of making the panels.
Figure 12:
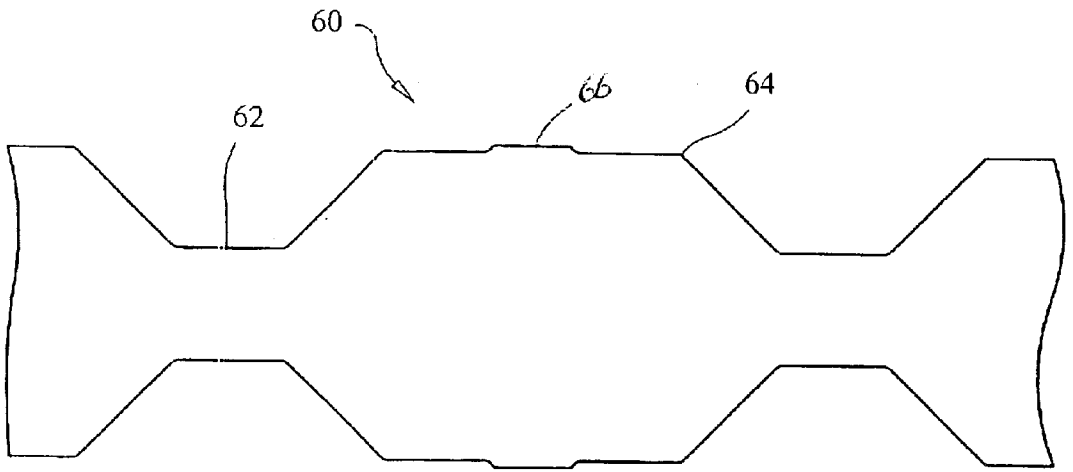
FIG. 12 is an elevational view of a second roller corresponding to the first roller of the machine used in the process of making the panels.

Each stage has a pair of cooperating rollers, except for the cam stage, with various contours to create the desired bends at each stage for ultimately defining the panel 14. For instance, with reference to FIGS. 11 and 12, rollers 50 and 60 are used in stage nine, as shown. Roller 50, as shown in FIG. 11, comprises Crests Forming Molds 52 and a valley there between having surface dimensions and contours that correspond to the Panel Trough 17 and Trough Channel 18. With reference to FIG. 12, a Cooperating Roller 60 is shown. The Cooperating Roller 60 comprises dimensions that correspond and mate with the First Roller 50, as shown. Thus, Roller 60 defines a Valley 62 that corresponds and mates with the Crests Mounts 52. Likewise, the Second Roller Central Mold 64 and End Molds 66 correspond to the valleys or recessions defined between and outside the Crests Molds 52 as defined by Roller 50. Rollers 50 and 60 are positioned and aligned to receive the Panel 14 therebetween in stage nine to complete the panel's 14 shape while passing therethrough. Accordingly, each stage has at least one pair of similar cooperating rollers and, or cams for creating the bends in stages. Consequently, the Panel 14 comprises a malleable material for facilitating the formation of the corrugated design.

Figure 13A:
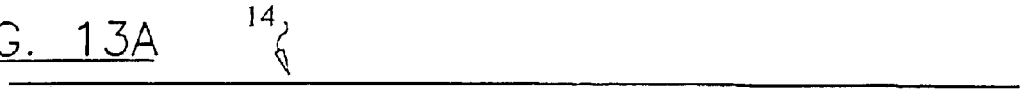
FIGS. 13A–13I are end views of the preferred panel at each stage as it is formed in accordance with the instant invention.
Figure 13B:
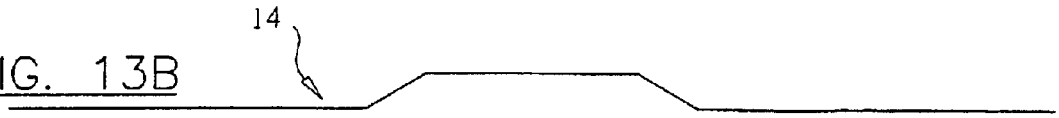

The bending machine of the instant invention 10 preferably comprises a plurality of roller stations or stages, such as five to nine stations, that contribute to the various bends in the Panels 14, as shown in FIGS. 13A–J and 19A–I. Each roller stage comprises rollers having unique contours for creating bends in the sheet in stages. The method of making the Panels 14 shapes the sheet as it passes through each roller stage. With reference to FIGS. 13A to 13I, a flat sheet of non-corrosive, waterproof material is converted into the corrugated Panel 14 by being fed through each stage. Referring to FIG. 13A, a mill coil of a flat sheet of material, preferably aluminum or other stainless alloy, is fed into the first stage by an unrolling machine. The bending machine of the instant invention supports the rollers at each stage and includes a sprocket, motor and gear system that rotates the rollers to draw and urge the sheet 14 through the rollers.

The first stage preferably has three electric shears that cut the sheet 14 into four pieces for making four Panels 14. The number of shears may vary for simultaneously making a different number of Panels 14. In the second stage, approximately fifty percent of the two inner or center bends are formed by the second stage rollers 51, 61, as shown in FIGS.

Figure 13C:
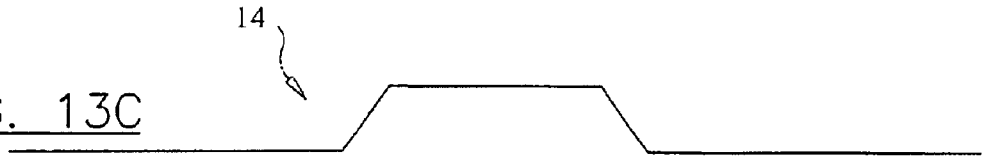
Figure 13D:
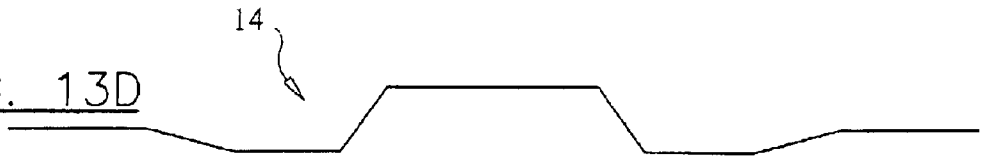
Figure 13E:
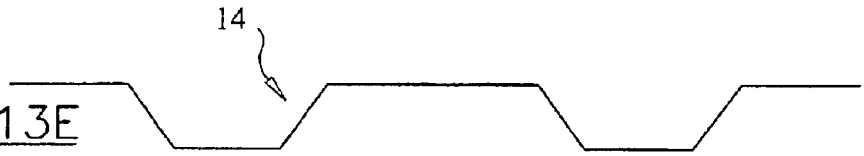
Figure 13F:
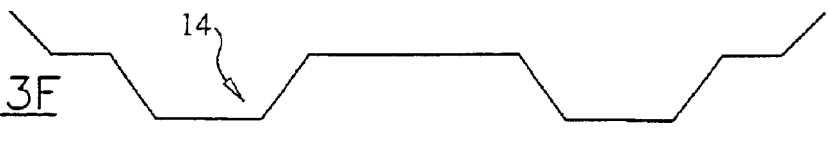
Figure 13G:
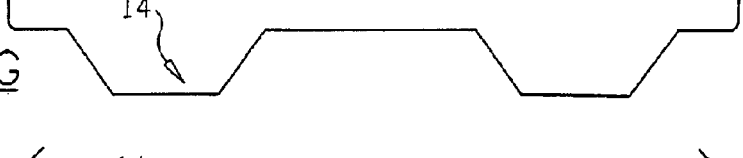
Figure 13H:
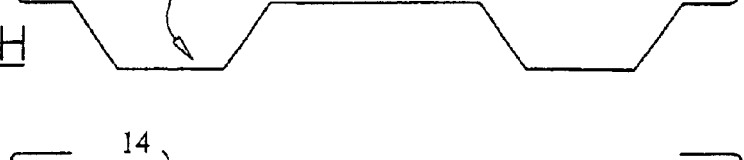
Figure 13I:
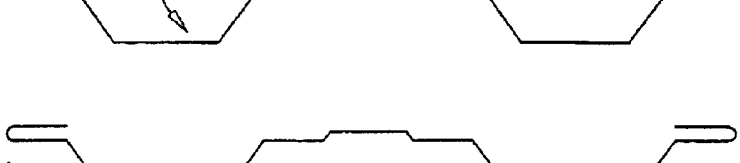
Figure 13J:
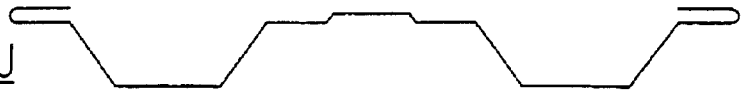
Figure 19A:
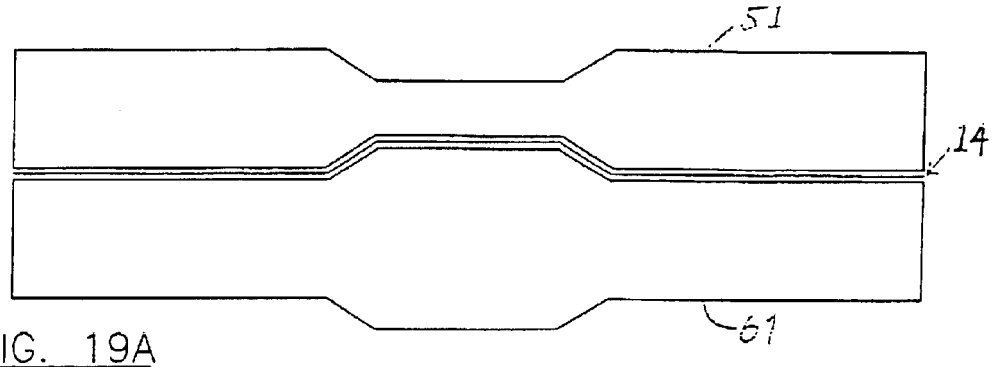
FIGS. 19A–19I are elevational illustrative views of the roller dies shaping panels (19A–19D and 19I) and the cam dies (19E–H) in accordance with the preferred embodiment of the instant invention.
Figure 19B:
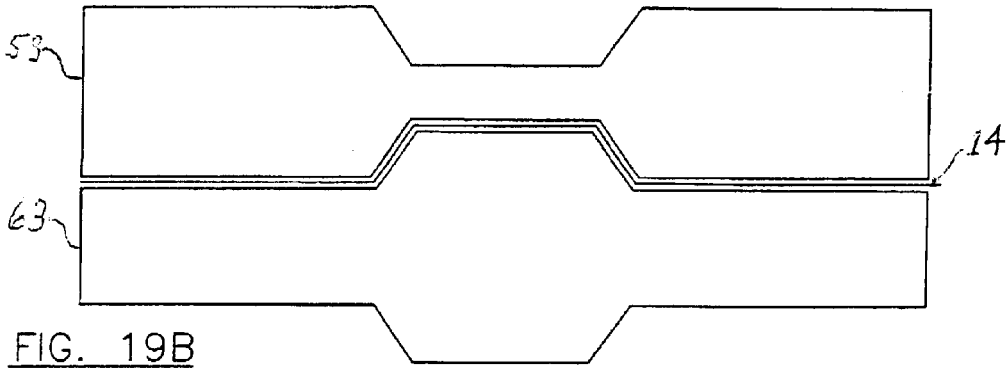
Figure 19C:
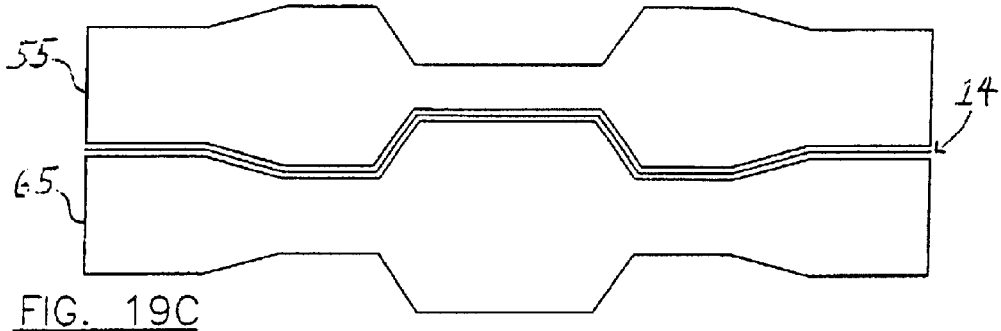
Figure 19D:
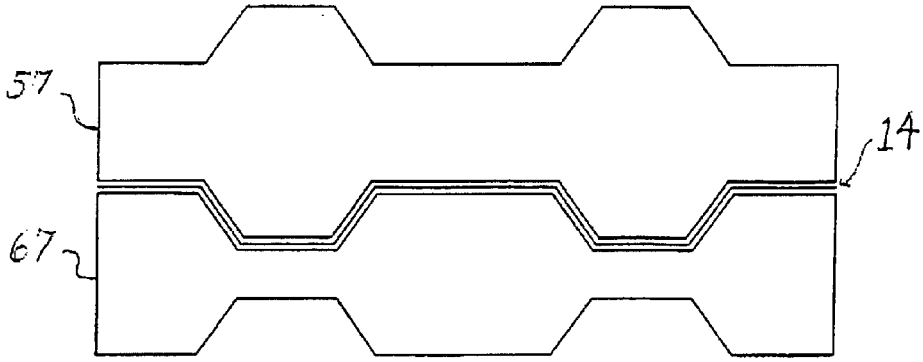
Figure 19E:
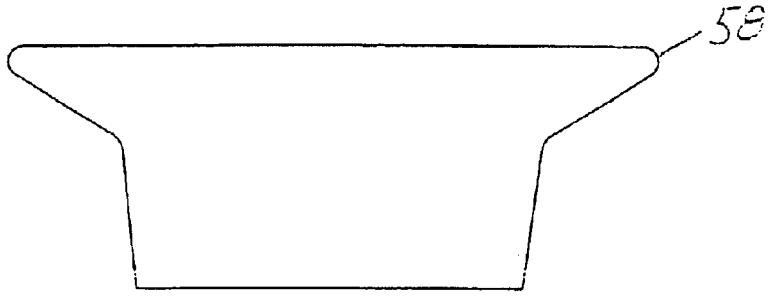
Figure 19F:
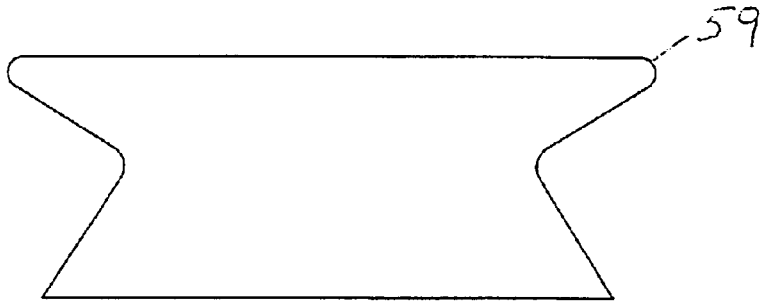
Figure 19G:
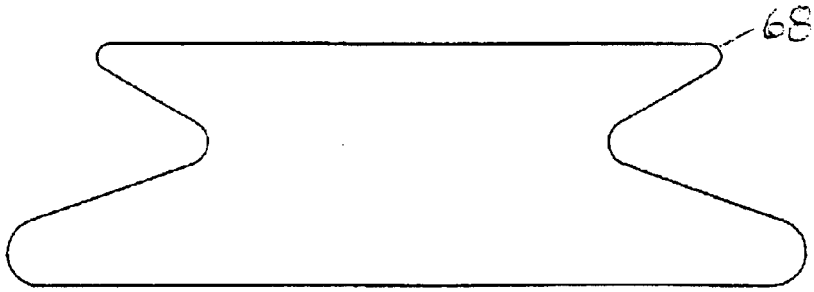
Figure 19H:
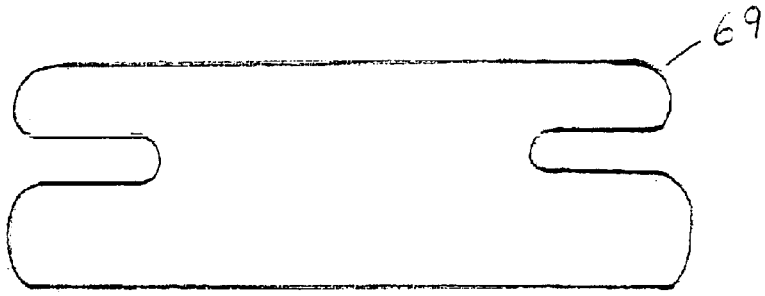
Figure 19I:
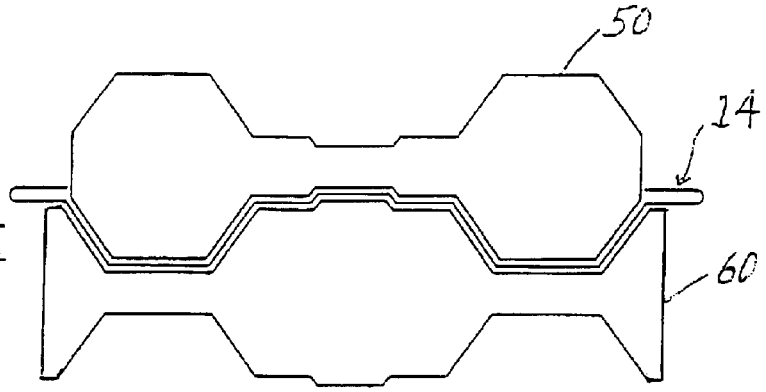

13B and 19A. In the third stage, the rollers 53, 63 form approximately one-hundred-percent of the inner bends to complete the center bends, as shown in FIGS. 13C and 19B. Referring to FIGS. 13D and 19C, the fourth stage rollers 55, 66 repeats 100% of the inner bends and fifty percent of the outer bends. In the fifth stage, the outer bends are completed to a hundred percent by rollers 57, 67, as shown in FIGS. 13E and 19D. The sixth, seventh, eighth and ninth stages form the flanges/hems 16 with cam pairs, as shown in FIGS. 13F–I and 19E–H. A pair of cams is used in each of these stages for creating the hems 16 along both side edges 19. In stage six, the pair of cams 58 bend the panel edges 19 approximately forty-five (45) degrees. In stage seven, the pair of cams 59 bend the panel edges 19 approximately ninety (90) degrees. In stage eight, the pair of cams 68 bend the panel edges 19 approximately one-hundred-thirty-five (135) degrees. In stage nine, a pair of cams 69 or the rollers 50 and 60 bend the panel edges to one-hundred-eighty (180) degrees to complete the hems 16, as shown in FIGS. 19H,I and 13I, J. The ninth or final stage fine tunes the bends and forms the channel 18 in the Panels 14, as shown in FIGS. 11 and 12. Thereafter the Panel 14 is cut into desired lengths.

Referring to FIG. 18, the Panel 14 has various sections with predetermined angles and lengths. These sections are designed to result in a substantially symmetrical Panel 14. The lengths and angles of the various sections, as shown in FIG. 18, may vary so long as the overall structural integrity and look of the Panels 14 are not compromised.

The method of installing the Fence 10 of the instant invention comprises obtaining the Posts 12, Post Mounts 20 and prefabricated fence sections comprising Channel Mounts 30 with pre-mounted Panels 14 or obtaining the Channel Mounts 30 and Panels 14 of the Fence System 10 and building the section at the site. The first step is securing the posts in the ground or ground like surface and securing two (2) Post Mounts 30 to each Posts 12. If a prefabricated fence section is used, then it is attached to the Post Mounts 14 by connecting and fastening the Channel Mounts 30 to or in the Post Mount Ledges 26 utilizing predrilled holes 81, if available, and conventional fasteners. If the section is built on site then the next step is bridging the distance between the Posts 12 with the lateral Channel Mounts 30, securing the Channel Mounts 30 at each End 32 to or in the Post Mount Channel Ledges 26 at each end and securing the panels to the frame with or without a gap there between depending on the preferred design. For a curved design, a curved Channel Mount 30 may be used. The posts 12 are secured in a ground like surface using conventional methods such as cement and/or dirt. The Post Mounts 20 are slid over the posts, preferably two Post Mounts 20 per Posts 12, and positioned at predetermined levels preferably spaced evenly on the Posts 12 at distances that enhance the structural integrity thereof. The Post Mounts 20 are secured to the Posts 12 using conventional fasteners. The Post Mounts 20 secured to a corresponding Posts 12 should be positioned at corresponding heights for creating a substantially level in the Fence 10. Thereafter, Channel Mounts 30 are mounted over the Post Mount Channel Ledges 26 at each end of the Channel Mounts 30. The Channel Mounts should have a length that bridges completely across and between the Posts 12 and Post Mounts 20. The Channel Mount 30 is secured to the Post Mount Channel Ledges 26 using conventional fasteners. Once the Channel Mounts 30 and Post Mounts 20 have been firmly secured, the installer may begin to affix the Panels 14 to the resulting fence frame assembly. A level line should be drawn across the top of the posts or at least at a level for dictating where the tops of the Panels 14 should terminate. The Panels 14 are secured to the fence assembly using conventional fasteners. The Panels 14 may be positioned on the fence frame with a defined gap there between. In order to more firmly secure the Panels 14 to the fence frame so as to prevent chattering and panel movement, the Small Clips 40 may be employed. To use the Small Clips 40, the method contemplates aligning and sliding the Clips 40 over opposing Flanges 16 of adjacently positioned Panels 14. The Clips 40 would preferably reside in alignment with the Channel Mounts 30 so as to not comprise the shadow box look. In a privacy design, the panels may be placed in touching engagement such that there is no gap there between with or without the use of Small or Large Clips 40, 42. In the preferred embodiment, the privacy design employs the Large Clip 42 for closing the gap between adjacent Panels 14. The Large Clip 42 is aligned and slidably engaged with corresponding Flanges 16 as described in reference to the Small Clips 40. The caps 40 or 42 are installed by mounting them over the panels 14.

Figure 17:
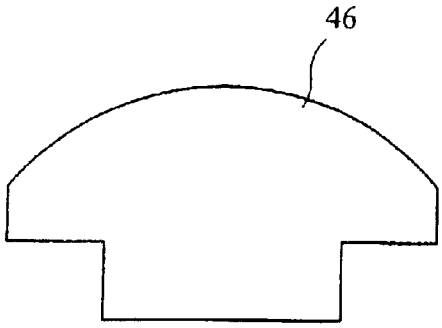
FIG. 17 is an end view of the preferred cap used in the instant invention.

The instant invention may further comprise railing caps, as shown in FIG. 17, to provide a railing system in the Fence System 10. The Railing Caps 80 may be employed to finish off the upper edges of the fence to provide a smooth rail-like finish. The Fence Caps 80 preferably comprise elongated caps that have lengths that correspond to the length of the Channel Mounts 30 and/or the distance between cooperating posts 12, and widths that correspond to the distance between Panels 14 secured on opposite sides of the Channel Mounts 30. Alternatively, the Railing Caps 80 may comprise a plurality of shorter caps that are used to finish off the upper and/or lower edge of the Fence 10.

Figure 20:
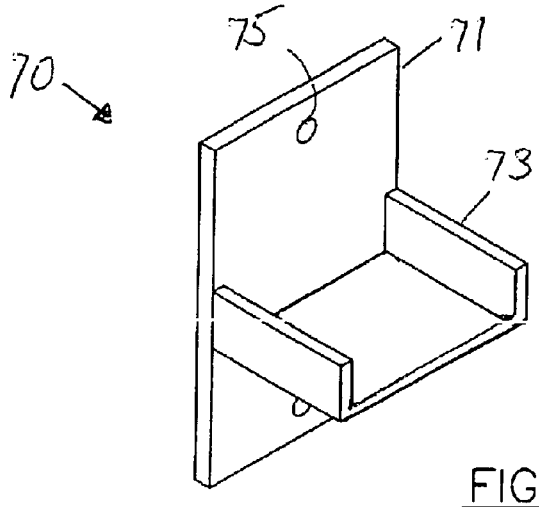
FIG. 20 is a perspective view of a U-shaped channel support for use in lieu of the post mount in accordance with an alternative embodiment of the instant invention.

It should be noted that the instant invention 10 can be employed as a fence system or a railing system. As a fence system, the Posts 12 are preferably secured in the ground. As a railing system, the Posts 12 are preferably mounted to or in a floor-like surface, such as a balcony, stairs or patio. As a railing system or in fence systems starting against a wall or other flat surface, a U-Shaped Channel Mount 70 may be used in place of the Post Mount 20. With reference to FIG. 20, the Channel Mount 70 comprises a Back Plate 71, U-Shaped Channel Support 73 adapted for receiving and supporting the Channel Mount 30 and at least one aperture 75 in the Back Plate 71 for securing the Channel Mount 70 to a surface. The Channel Mount 70 may comprise a single molded part or the Channel Support 73 may be welded to the Back Plate 71 or attached with pop rivets or other conventional fasteners. The Channel Mount 30 preferably fits flush with and securely in the Channel Support 73 to prevent vibration and chatter between the parts. The Wall Mount 70 is used on flat structural surfaces, such as walls and columns, to support opposite ends of the Channel Mounts 30 across balconies, stairs and other areas that require a railing system. The Wall Mount 70 may also be used as a starter mount.

Figure 21:
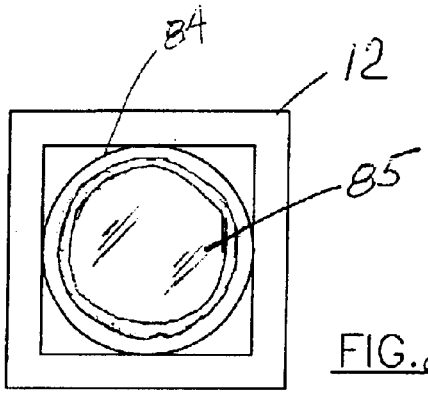
FIG. 21 is a plan view of the security post rod used in the security system in accordance with an alternative embodiment of the instant invention.
Figure 22:
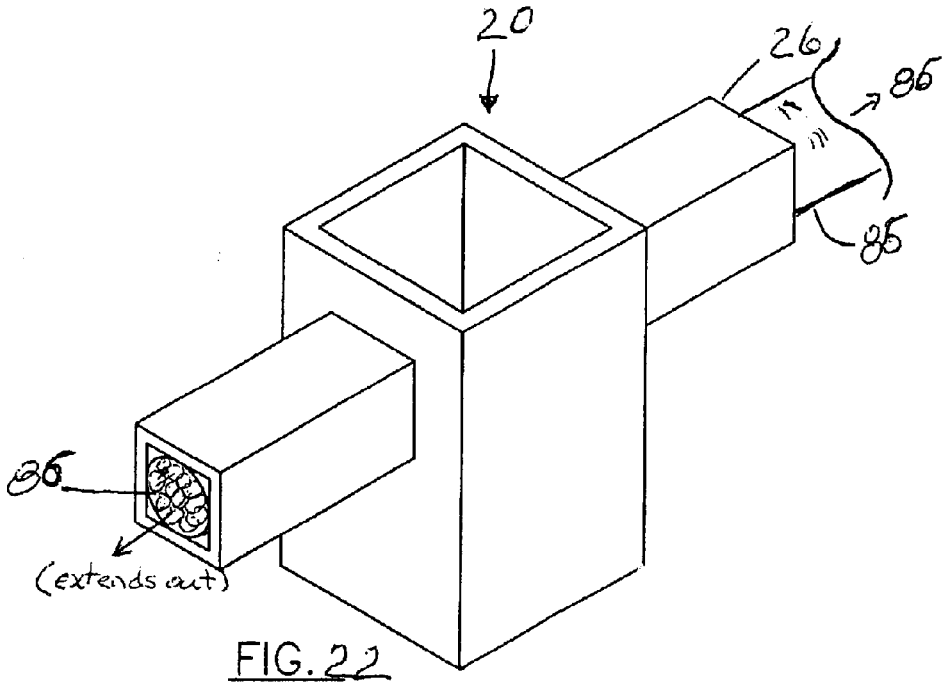
FIG. 22 is a perspective view of the security channel rod used in the security system in accordance with an alternative embodiment of the instant invention.

In the preferred embodiment, the Fence System 10 may also include structure for securing the fence 10 or portions thereof from theft and vandalism with the dual benefit of providing a crash barrier. With reference to FIG. 21, the Fence System comprises a cylinder 84 with a hardened solid round Rod 85 loosely encapsulated in the cylinder 84 so that it rotates if there is any attempt to saw or otherwise cut through the Post 12. With reference to FIG. 22, the Fence System 10 may also include or alternatively include a steel strand cable 86 inserted or insertable through the Channel Mounts 30, Post Mount Ledges 26, and Posts to strengthen the Ledges 26 and Channel Mounts 30 as well. The designs shown in FIGS. 21 and 22 prevent fence penetration and provide crash or impact resistance.

In another embodiment and, or in conjunction with other embodiments, the Fence System 10 may include low voltage security electrical sensors, switches and, or trip wires that cause an alarm to be sounded if electrical continuity is broken and, or the sensors are triggered. Wires may be run through the hollow passages of the Channel Mounts 30, Posts 12 and, or Post Mounts 20. As the Fence Panels 14 are corrosion resistant they may be submerged in the ground or concrete.

The Fence System may include barbed wire, which can be attached to the Fence Panels 12, Channel Mounts 30 and or Posts 12. The barbed wire may be one-sided or double sided with three, six or nine wires. The barbed wire is preferably attached to the Posts 12 with a wedge lock anchor or insert, U-shaped cap 80 with thru-bolts or U-Shaped cap 80 that is welded to the Post 12.

The Fence System 10 may also include light or lamp post attachments, with or without electrical capability, that accommodate a plurality of different lamp styles. An electrical junction box may also be included, preferably mounted or mountable to the Post 12 proximal the top end, to isolate wiring for lighting, alarm systems and other electrical accessories.

In an alternative embodiment, the instant invention 10 may be adapted for use as a sound barrier. The Panels 14 would preferably comprise a material conducive for repelling, baffling and, or absorbing sound.

The Fence System 10 of the instant invention may include gates made with the same or similar material and components. The gate includes hinges for attachment to a Post 12. The gates may include locks and, or latches.

The instant invention has been shown and described herein in what is considered to be the most practical and preferred embodiment. It is recognized, however, that departures may be made therefrom within the scope of the invention and that obvious structural and/or functional modifications will occur to a person skilled in the art.

What is claimed is:

1. A rust proof and modular fence system comprising:

a plurality of corrugated panels having two side edges, a top end and a bottom end;

a flange defined by each of said side edges, said flanges comprising an end section of said side edges wrapped back over said side edges in substantially a parallel orientation, said flanges providing a smooth finished edge for convenient handling, structural reinforcement and structure that may be selectively employed for interlocking adjacent panels; and means for securely supporting said panels in a substantially upright position; said panel supporting means comprising at least one channel mount having two ends, said channel mount being laterally supportable at each said end by a lateral projecting ledge, and ledge support means for supporting said ledge in an elevated position.

2. A system as recited in claim 1, wherein said panels further comprise:

a recessed channel extending substantially between said top and bottom ends for facilitating a uniform look when said panels are positioned adjacently with a space therebetween.

3. A system as recited in claim 1, further comprising:

a clip mountable to said panels that are adjacent, said clip having flanges that mate with said panel flanges for securing said panels and controlling the spacing between said adjacent panels.

4. A system as recited in claim 3, wherein said clip has a height that is substantially the same length as the length between said top end and bottom end of said panels.

5. A system as recited in claim 3, wherein said clip has a height between a top edge and a bottom edge that is substantially the same height as said height defined by said channel mount.

6. A system as recited in claim 1, wherein said ledge support means comprises:

a mounting plate adapted for attachment to a substantially vertical surface, said ledge laterally projecting from said mounting plate.

7. A system as recited in claim 6, wherein said ledge support means comprises:

a post having at least one flat side; and a post mount adapted for mounting to said post, said ledge laterally projecting from said post mount.

8. A system as claimed in claim 7, wherein said post mount comprises:

a passageway for receiving said post.

9. A system as recited in claim 8, wherein said channel mount has an open side for mounting over said ledge.

10. A system as recited in claim 7, wherein said panels are securable to different sides of said channel mount.

11. A system as recited in claim 10, further comprising an elongated cap that mounts over the top end of said panels to fill the space between said panels and for covering the top end of said panels.

12. A system as recited in claim 1, further comprising a cap that is mountable over at least one end of said panels to conceal sharp edges.

13. A system as recited in claim 1, wherein said system comprises a substantially corrosion and moisture resistant alloy based material.

14. A system as recited in claim 1, wherein said system comprises aluminum.

15. A system as recited in claim 1, wherein said channel mount comprises:

a curved section.

16. A system as recited in claim 1, further comprising:

a security rod insertable in said channel mount for reinforcing said channel mount.

17. A system as recited in claim 7, wherein said post mount comprises more than one said ledge laterally projecting from said post mount.

* * * * *